US009574344B2

(12) United States Patent
Case

(10) Patent No.: US 9,574,344 B2
(45) Date of Patent: Feb. 21, 2017

(54) BUILDING STRUCTURAL CONNECTOR

(71) Applicant: Alan Case, Braintree, MA (US)

(72) Inventor: Alan Case, Braintree, MA (US)

( * ) Notice: Subject to any disclaimer, the term of this patent is extended or adjusted under 35 U.S.C. 154(b) by 0 days.

(21) Appl. No.: 14/308,332

(22) Filed: Jun. 18, 2014

(65) Prior Publication Data

US 2014/0318077 A1 Oct. 30, 2014

Related U.S. Application Data

(63) Continuation-in-part of application No. 13/873,825, filed on Apr. 30, 2013, now abandoned.

(51) Int. Cl.

| | |
|---|---|
| ***E04B 1/82*** | (2006.01) |
| ***E04B 1/74*** | (2006.01) |
| ***E04B 9/00*** | (2006.01) |
| ***E04C 3/29*** | (2006.01) |
| *G10K 11/00* | (2006.01) |

(52) U.S. Cl.

CPC . *E04B 1/82* (2013.01); *E04B 1/74* (2013.01); *E04B 9/001* (2013.01); *E04C 3/29* (2013.01); *E04B 2001/8254* (2013.01); *G10K 11/00* (2013.01); *Y10T 156/10* (2015.01); *Y10T 403/45* (2015.01)

(58) Field of Classification Search

CPC ..... E04B 9/001; E04B 9/34; E04B 9/04; E04B 1/74; E04B 1/99; E04B 2002/0202; E04B 2002/0243; E04B 2002/025; E04B 2001/00; E04B 2002/0234; E04B 2001/8461; E04B 2001/8471; E04B 1/82; E04B 2001/8254; G10K 11/00; G10K 11/168; E04C 3/29

USPC ..... 52/167.7, 167.8, 144, 145, 502, 630, 52/801.1, 801.11, 403.1, 480; 428/119, 428/120, 122; 156/295, 87, 290, 294

See application file for complete search history.

(56) References Cited

U.S. PATENT DOCUMENTS

| | | | | |
|---|---|---|---|---|
| 1,195,289 | A | 8/1916 | Stevens | |
| RE18,573 | E * | 8/1932 | Kocher | E04F 15/20 52/402 |
| 1,928,034 | A * | 9/1933 | Schulstadt | E04B 1/86 181/290 |
| 2,014,694 | A * | 9/1935 | Olschner | E04B 1/8409 181/292 |
| 2,031,950 | A * | 2/1936 | Harshberger | B28B 1/52 181/290 |
| 2,367,392 | A * | 1/1945 | Gent | 52/390 |
| 2,573,482 | A * | 10/1951 | Peik | E04B 1/86 181/284 |
| 3,332,170 | A * | 7/1967 | Bangs | 49/400 |
| 3,344,574 | A * | 10/1967 | Palfey | 428/120 |
| 3,421,281 | A | 1/1969 | Harris | |
| 3,788,021 | A * | 1/1974 | Husler | 52/403.1 |
| 4,067,163 | A * | 1/1978 | Hetman | 52/204.591 |
| 4,110,948 | A * | 9/1978 | Maier, Jr. | 52/402 |
| 4,187,573 | A * | 2/1980 | Fyfe et al. | 14/73.5 |
| 4,227,359 | A | 10/1980 | Schlenker | |

(Continued)

FOREIGN PATENT DOCUMENTS

DE 10106462 A1 * 9/2001 ..... E01F 8/0082

*Primary Examiner* — Babajide Demuren

(74) *Attorney, Agent, or Firm* — Lambert & Associates; Gary E. Lambert; David J. Connaughton, Jr.

(57) ABSTRACT

A structural connector is provided that limits transmissions of vibrations between connected structural elements in a building or structure. The structural connector is formed from two opposing sheets with a vibration damping material connecting the two.

16 Claims, 18 Drawing Sheets

(56) References Cited

U.S. PATENT DOCUMENTS

| | | | | |
|---|---|---|---|---|
| 4,338,758 | A * | 7/1982 | Hagbjer | F16F 9/30 188/268 |
| 4,525,081 | A | 6/1985 | Myhre | |
| 4,663,224 | A | 5/1987 | Tabata et al. | |
| 4,677,798 | A * | 7/1987 | Phillips | 52/106 |
| 4,757,663 | A | 7/1988 | Kuhr | |
| 5,054,251 | A | 10/1991 | Kemeny | |
| 5,063,098 | A | 11/1991 | Niwa et al. | |
| 5,609,006 | A * | 3/1997 | Boyer | 52/481.1 |
| 5,800,888 | A | 9/1998 | Yasumoto et al. | |
| 6,171,705 | B1 | 1/2001 | Clifford | |
| 6,202,462 | B1 | 3/2001 | Hansen et al. | |
| 6,266,936 | B1 * | 7/2001 | Gelin | 52/481.1 |
| 6,267,347 | B1 | 7/2001 | Ryan et al. | |
| 6,494,012 | B2 * | 12/2002 | Seng | 52/841 |
| 7,093,814 | B2 * | 8/2006 | Meisel et al. | 248/562 |
| 7,895,803 | B2 | 3/2011 | Downey et al. | |
| 8,097,194 | B2 | 1/2012 | Boss | |
| 8,181,738 | B2 | 5/2012 | Tinianov et al. | |
| 2004/0168377 | A1 | 9/2004 | Sedrak | |
| 2008/0086966 | A1 | 4/2008 | Stevens et al. | |
| 2009/0283359 | A1 | 11/2009 | Ravnaas | |
| 2010/0101171 | A1 * | 4/2010 | Clifton et al. | 52/588.1 |
| 2011/0047908 | A1 | 3/2011 | Brusman et al. | |

* cited by examiner

BUILDING STRUCTURAL CONNECTOR

PRIORITY CLAIM

This application is a continuation-in-part utility patent application which claims the benefit to and priority from non-provisional utility patent application Ser. No. 13/873,825 filed on Apr. 30, 2013.

BACKGROUND OF THE INVENTION

Field of the Invention

The present invention relates generally to building construction. More particularly the present invention relates to a vibration damping, sound isolating, structural connector to connect various building elements to aid in sound proofing and noise reduction.

Description of Related Art

In the field of vibration damping products, a common solution is the composite type of vibration damping materials comprising a metal sheet and a viscoelastic polymeric material. One example of such a vibration damper is formed of a thin steel sheet and a rubber or synthetic resin-based viscoelastic polymeric layer bonded to both sides thereof, and another vibration damper formed by sandwiching and bonding a viscoelastic polymeric layer between two steel sheets.

Said composite type of vibration dampers are used in a wide range of industrial fields such as automotive engine mounts, disc brakes, oil pans, transmissions, compressors, air cleaners, brake clutches, electronic ranges, speakers and players. However, the vibration dampers of the prior art are not structurally capable of supporting large or complex loads or resisting specific significant forces, such as those experienced during building construction.

Other sound-proofing systems include the use of substantial insulation, and specially designed building materials. Both of these systems are costly, and can be difficult to install. Further, these existing approaches to sound proofing are generally topical applications that merely muffle sound on the surface. Structural elements are not used in sound-proofing systems.

Cavity insulation decreases airborne sound transmission but has no effect on structure borne sound such as impact noise that travels a direct path through very dense materials.

Another approach involves staggered stud walls, which are actually double studded walls whereby the opposing wall finishes do not share fastening to common studs. This practice only partially controls sound transmission as both studs walls are attached to the same top and bottom plates allowing for wall impacts to travel up into the ceiling plane and down through the floor system. Attempts are also made to control noise by adding extra layers of sheetrock or installing sheets of mass-loaded vinyl between sheets of sheetrock. Again, these features fail in preventing structural transmission of sounds, and merely muffle some sound transmission.

Therefore, what is needed is a device that may provide adequate vibration damping that is also capable of being an integral part of a building structure, and capable of withstanding heavy loads such as those experienced in a building and during building construction.

SUMMARY OF THE INVENTION

The subject matter of this application may involve, in some cases, interrelated products, alternative solutions to a particular problem, and/or a plurality of different uses of a single system or article.

In one aspect, a structural connector for joining structural elements of a building together is provided. The structural connector comprises two sheets bonded together by a vibration damping material. The two sheets are opposing each other, and have a vibration damping material between them, such that no part of the first sheet is in contact with the second sheet. A reinforcing structure may protrude from one or both of the sheets into the vibration damping material.

In another aspect, methods of using the structural connector are provided. In one embodiment a method of sound-proofing a room during construction of the room is provided. The method involves connecting a plurality of studs to a top and bottom plate, forming a wall framing. The top plate may be attached to a top joist and the bottom plate may be attached to a bottom joist using a number of structural connectors, one structural connector used for each connection between top/bottom plate, and joist. Further, the method may involve connecting a ceiling to a joist by attaching the connector to the joist, and then the attaching ceiling to the connector. Further still, a floor may be connected to a joist by attaching the connector to the joist, and then attaching the floor to the connector.

DETAILED DESCRIPTION

Figure 1:
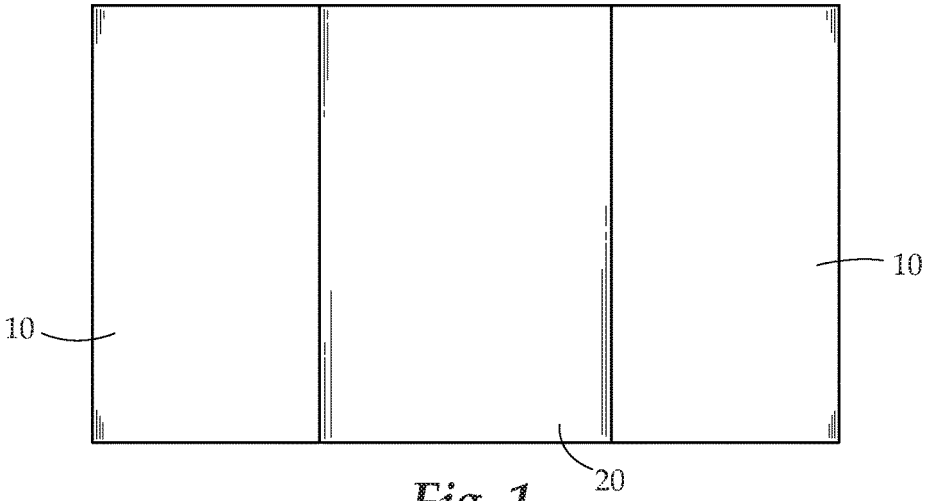
FIG. 1 provides a top view of an embodiment of the structural connector.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a structural connector comprising opposing sheets, and a vibration damping material joining the sheets. The structural connector is used to connect structural elements of buildings together, isolating the connector faces and limiting vibrations travelling between them.

The structural connectors may be used in soundproofing, which is indented herein to refer to not only full soundproofing, but also sound isolating, limiting, noise reduction, sound attenuation, vibration damping and vibration limiting.

The connectors may be used to join any building structural elements together. For example, the structural connector may be used to join: a floor element to a wall element, wall element to a beam, a column to a floor element, sheetrock furring to a wall element, a ceiling element to a floor element above, a stair stringer to a floor landing, door frame components to wall openings, noise generating mechanical equipment and piping to floors, walls, ceilings and roofs, a rafter to a stud, a rafter to a joist, roof connections, and the like. These building structural elements may be constructed of any material used in building structures, such as metal, wood, composites, or pre-fabricated panels.

The structural connectors may be formed of two or more opposing sheets joined together by a vibration damping material. The opposing sheets may be constructed of any material suitable for connection of the structural elements. Examples of the sheet material may include metals such as steel, aluminum, stainless steel, and the like, wood, composites, and plastics materials, among others. Generally, the sheets will be separated by the vibration damping material, such that there is no rigid connection between them. The separation of the sheets by the vibration damping material functions to prevent or at least limit transmission of vibrations, such as sound, between the opposing sheets.

Each sheet may be shaped in any manner such that there is no rigid connection between them. In one embodiment, edges of the sheets may be bent inward, such that the bent portion extends towards the opposing sheet. In a further embodiment, portions of one or both of the sheets may extend away from the vibration damping material to facilitate connection, shaping, and the like. In one embodiment the extending portions of the sheet may have perforations to facilitate placement of fasteners for attachment of the connector to building elements and/or ease bending of the sheets.

One or a plurality of reinforcing structures may be attached to, or formed by, inner surfaces of a sheet. These reinforcing structures function to secure a connection between the sheets and the vibration damping material. The reinforcing structures may further prevent shearing and other deformation of the vibration damping material when under load. The reinforcing structure may be made of any material, including, but not limited to, metals, wood, composites plastics, or fibers.

In one embodiment, the reinforcing structure may be a reinforcing ladder. This ladder is formed as an elongated element aligned lengthwise or width-wise along an inner surface of one sheet. The elongated element is attached to the sheet by a plurality of rungs along the length of the element, thereby creating a ladder-shaped reinforcing structure.

In another embodiment, the reinforcing structure may be a T-shaped bracket along at least a part of a length or width of an inner surface of a sheet. The bottom of the T-shape being attached to the sheet. In a further embodiment, transverse protrusions may extend from the top of the T shape along its length, further reinforcing the structural connector. In yet a further embodiment, the T-shaped reinforcing structure may form one or a plurality of apertures along its surface.

In other embodiments, the reinforcing structures may be a bracket. The bracket may have any protrusion from the sheet of any shape capable of gripping and securing the sheet to the reinforcing material. For example, the reinforcing structures may be L shaped, I shaped, may have apertures along their lengths, may be hook shaped, and the like. In another embodiment, the sheets may be bent inward at their edges, the bent portions acting as reinforcing structures to hold in the vibration damping material. In some embodiments, a plurality of different reinforcing structures may be used on one structural connector.

In some embodiments, a quantity of mesh or netting may be disposed within the vibration damping material as reinforcement. In some embodiments the mesh or netting may be attached to one or both of the opposing sheets.

The vibration damping material may be any material capable of absorbing and dissipating vibrations, particularly sound vibrations. Further, in some embodiments, the vibration damping material must be capable of holding a weight of a building structural element under either a compression, pulling, or shearing force, without substantial distortion or deformation.

Examples of desirable vibration damping materials may include elastic materials, visco-elastic materials, and the like. Examples may include silicone based materials, rubbers, plastics, flexible epoxies, foam type materials, composites, and the like. In one embodiment, the vibration damping material may be capable of being in a fluid form which can later be cured or set, thereby aiding in the manufacture of the structural connectors. In a particular embodiment, the vibration damping material may be a silicone based air-curable material.

An edge support may be disposed along an edge of the structural connector, particularly along edges wherein the vibration damping material is exposed. The edge support may prevent a deformation of the vibration damping material both outwardly and inwardly. Examples of edge supports may be a fiber mesh, a film adhered to the vibration damping material surface, strips of film, strips of fiber, and the like.

The structural connector may be made in any manner capable of creating the device having at least two opposing sheets connected by a vibration damping material with no rigid connection between the sheets. In one embodiment, a mold may be utilized to make the structural connector. The mold may be formed as a trough having a rectangular or approximately rectangular cross section and an open top. As such, the sheets may have rectangular flat portions to match one side of the mold. In the mold, sheets may be placed on opposing sides, with a gap between them. Next, the vibration damping material in liquid form may be poured into the mold between the sheets. The mold may have capped ends and a sealed bottom to prevent the liquid from escaping. Once the liquid vibration damping material is poured in and reaches a proper level, it may be allowed to set or cure into a solid state. Once the setting or curing is finished, the structural connector may be removed in one solid piece, the two sheets being connected together by the vibration damping material. In one embodiment, this solid piece may subsequently be cut into smaller pieces. Piece size cutting may be based on construction needs, the size of the structural elements being connected, and other building considerations.

In one embodiment of the structural connector in use, a connection between a joist and a wall assembly may involve the joist attached to a top wall plate by the structural connector. Two pieces of wood strapping, one on each side of the structural connector may be used to facilitate attachment of the connector to the joist and connector to the top wall plate. In other words, connection is from a wall top plate to the strapping, strapping to the connector, connector to another piece of strapping on the opposite sheet, and the strapping to a joist.

It should be understood that the structural connector described herein may also be used for any connection of two objects, not simply connection of building structural elements. For example, in one embodiment, the structural connector may be used as a raft connector. The raft connector may be positioned on a wall, ceiling, floor, or other surface and useable to connect items thereto. The items may be anything that would be desired to attach to a wall, ceiling or the like, such as HVAC equipment, cooking or bathroom exhaust equipment, loudspeakers, televisions, or appliances.

In another embodiment a plurality of structural connectors may be used to at least partially vibrationally isolate a room from the rest of the building. In this embodiment, numerous structural connector may be used, one between each structural element connecting the room to the remainder of the building. For example, a structural connector may be used at each connection point between a wall assembly and a floor assembly or floor rim joist, wall and ceiling assembly or ceiling rim joist, and wall corner connections. In a further embodiment, structural connectors may be used to attach wall studs to top and/or bottom plates. In yet other embodiments, a structural connector or a plurality of connectors may isolate a floor from a subfloor and/or a ceiling from a subfloor above the ceiling.

The room as described in this embodiment may be isolated from any direct structural connections between its structural elements and the structural elements of the remainder of the building. In further embodiments, each room may additionally utilize the structural connectors to further vibrationally isolate each room.

In embodiments of construction wherein pre-fabricated walls and floors are formed, a plurality of structural connectors may be used to connect the pre-fabricated walls and floors to each other and structural elements to which they are attached, such as foundation walls, beams and/or columns.

In another embodiment of a method the connectors in use involves a wall bottom plate being attached to the soundproofing structural connector noted above that is mounted to floor joists and/or rim board (such as a floor assembly). Similarly, a wall top plate may be attached to another soundproofing structural connector. In another embodiment, a wall bottom plate may be attached to connectors mounted on a wall top plate. In similar embodiments, a concrete or engineered panel floor slab may be attached to structural connectors mounted on the top or face of a wall. The walls in turn may be connected to other ceiling or floor slabs by the structural connectors. In yet another embodiment, elevated floor assemblies may be attached to subfloors by the structural connectors. In still another embodiment, stair stringers may be attached to connectors mounted on top and bottom floor landings by the structural connectors. In yet still another embodiment, gypsum wall and ceiling panels may be attached to furring strips which are attached to the structural connectors mounted on wall and/or ceiling structures. These wall and/or ceiling structures may be part of a new construction, or may be existing.

Turning now to FIG. 1 a top view of an embodiment of a structural connector is provided. The first sheet 10 and second sheet 20 are both visible, the first sheet 10 being wider than the second sheet 20 in this embodiment. The wider sheet 10 provides surfaces for fastening the connector a structural element. Isolated components are then fastened to the face of sheet 20.

Figure 2:
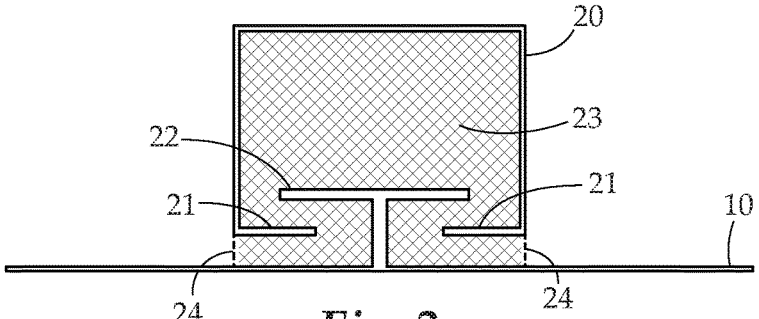
FIG. 2 provides a side view of an embodiment of the structural connector.

FIG. 2 shows a cross sectional view of another embodiment of the structural connector. The second sheet 20 is positioned above the first sheet 10. The two sheets 10, 20 are joined by a vibration damping material 23 which fills in all space between the first and second sheet 10, 20. A portion of the vibration damping material 23 is exposed 24. A T-shaped reinforcing structure 22 extends from the first sheet. Further, the second sheet has an inwardly bent portion 21 that may further act as a reinforcing structure. The first sheet 10 has portions extending away from the vibration damping material 23 on both sides. The T-shaped reinforcing structure 22 and the inwardly bent portions 21 may serve to increase the surface area available for gripping the vibration damping material 23 and may also increase resistance to shear and compression.

Figure 3:
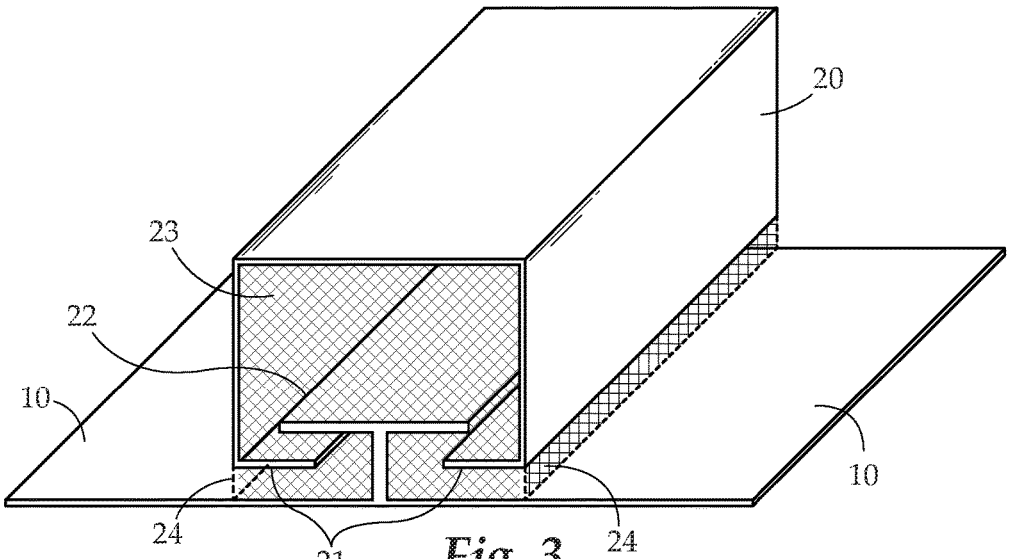
FIG. 3 provides a perspective view of an embodiment of the structural connector.

FIG. 3 provides a perspective view of another embodiment of the structural connector. The second sheet 20 is positioned above the first sheet 10. The two sheets 10, 20 are joined by a vibration damping material 23 which fills in all space between the first and second sheet 10, 20. A portion of the vibration damping material 23 is exposed 24. A T-shaped reinforcing structure 22 extends from the first sheet. Further, the second sheet has an inwardly bent portion 21 that may further act as a reinforcing structure. The first sheet 10 has portions extending away from the vibration damping material 23 on both sides. These extended portions may be solid surfaced or perforated to accommodate field bending or fastener installation.

Figure 4:
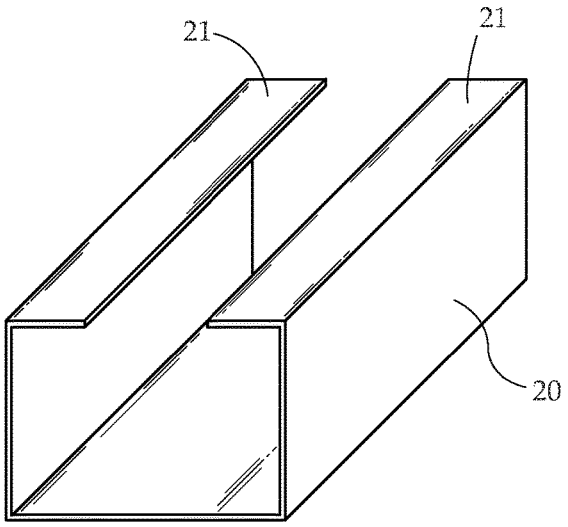
FIG. 4 provides a perspective view of a sheet of an embodiment of the structural connector.

FIG. 4 provides a perspective view of an embodiment of a sheet. In this embodiment, the sheet 20 is 'C' shaped, having inwardly projecting portions 21. These portions may act as reinforcing structures and be surrounded by the vibration damping material when mounted in the structural connector.

Figure 5:
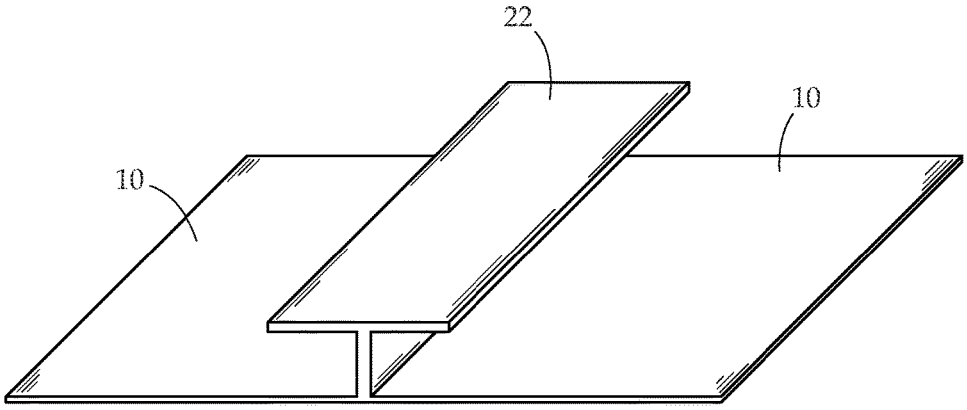
FIG. 5 provides a perspective view of another sheet of an embodiment of the structural connector.

FIG. 5 provides a perspective view of an embodiment of a sheet. In this embodiment, the sheet 10 has a central T-shaped reinforcing structure extending from its top surface.

Figure 6:
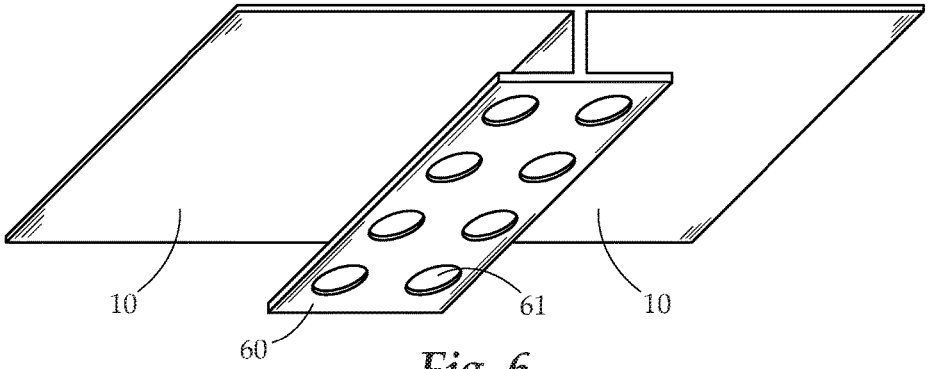
FIG. 6 provides a perspective view of another sheet of an embodiment of the structural connector.

FIG. 6 provides a perspective view of an embodiment of a sheet. In this embodiment, the sheet 10 has a central T-shaped reinforcing structure 22 extending from its top surface. A top of the T shape 60 forms a plurality of apertures 61 through which vibration damping material (not shown) may pass, and bind to during the forming of the structural connector.

Figure 7:
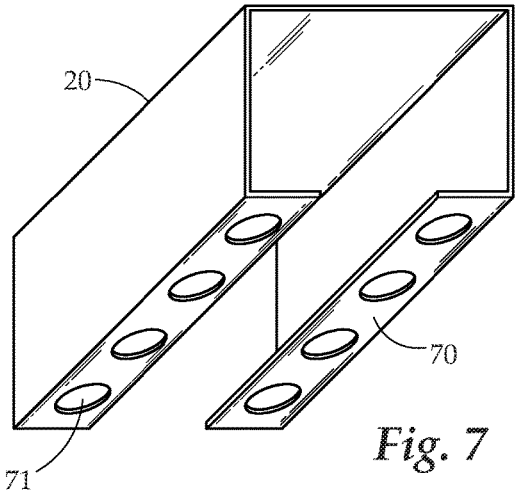
FIG. 7 provides a perspective view of another sheet of an embodiment of the structural connector.

FIG. 7 provides a perspective view of an embodiment of a sheet. In this embodiment, the sheet 20 is 'C' shaped, having inwardly projecting portions 70. The inward projecting portions 70 form a plurality of apertures 71 through which vibration damping material (not shown) may pass, and bind to during the forming of the structural connector.

Figure 8:
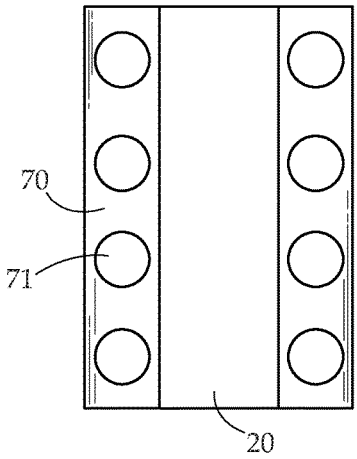
FIG. 8 provides an elevation view of another sheet of an embodiment of the structural connector.

FIG. 8 provides a top view of an embodiment of sheet. In this embodiment, the sheet 20 is 'C' shaped, having inwardly projecting portions 70. The inward projecting portions 70 form a plurality of apertures 71 through which vibration damping material (not shown) may pass, and bind to during the forming of the structural connector.

Figure 9:
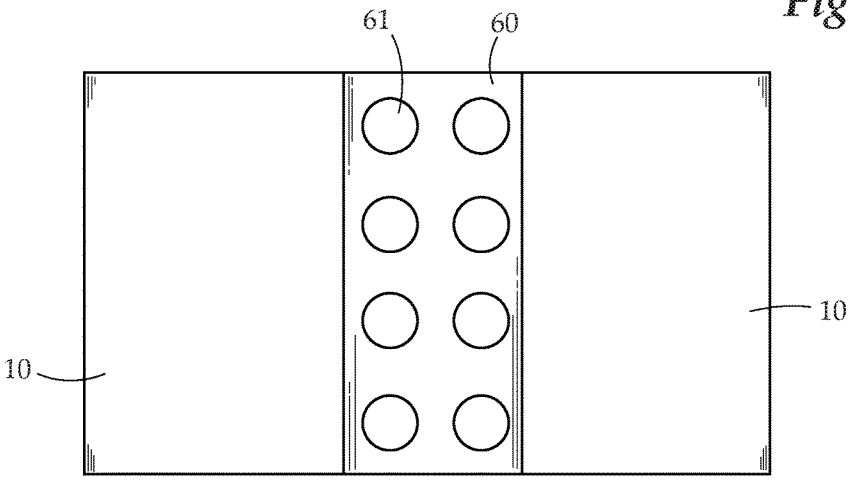
FIG. 9 provides an elevation view of another sheet of an embodiment of the structural connector.

FIG. 9 provides a top view of an embodiment of a sheet. In this embodiment, the sheet 10 has a central T-shaped reinforcing structure extending from its top surface. A top of the T shape 60 forms a plurality of apertures 61 through which vibration damping material (not shown) may pass, and bind to during the forming of the structural connector.

Figure 10:
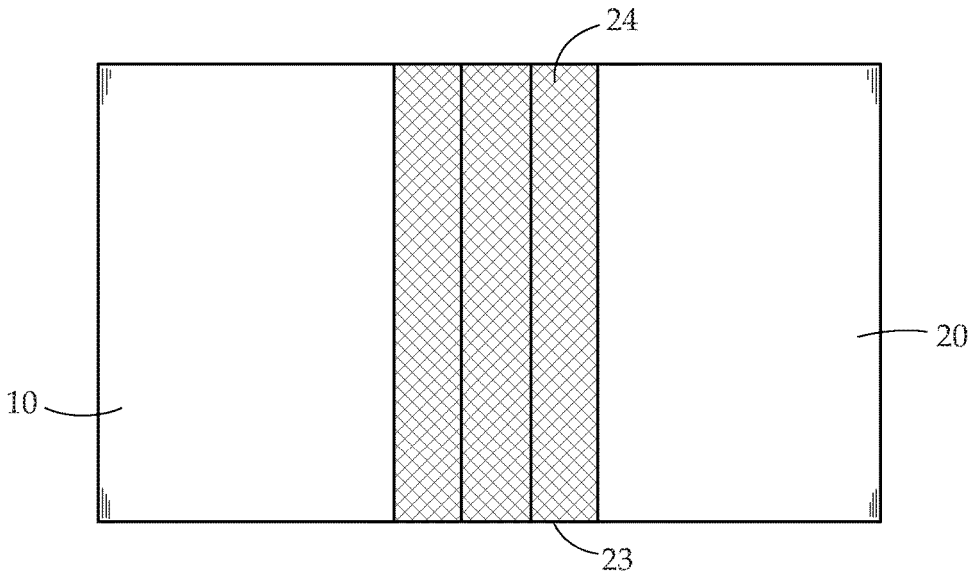
FIG. 10 provides an elevation view of still another embodiment of the structural connector.

FIG. 10 provides an elevation view of still another embodiment of a structural connector. In this embodiment the first sheet 10 and second sheet 20 are separated by a quantity of vibration damping material 23. The vibration damping material has an exposed portion 24 separating the sheets 10, 20.

Figure 11:
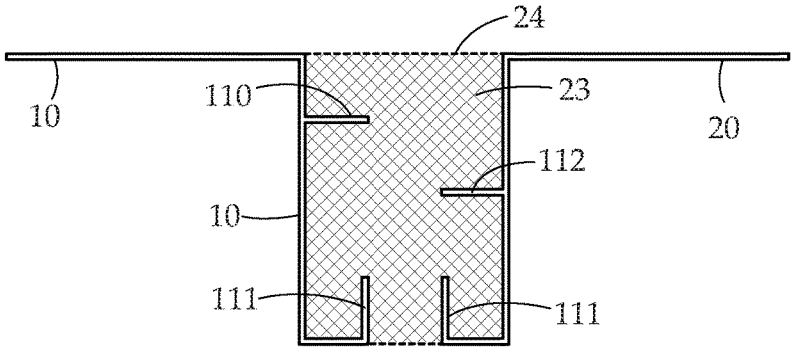
FIG. 11 provides a side view of another embodiment of the structural connector.
Figure 12:
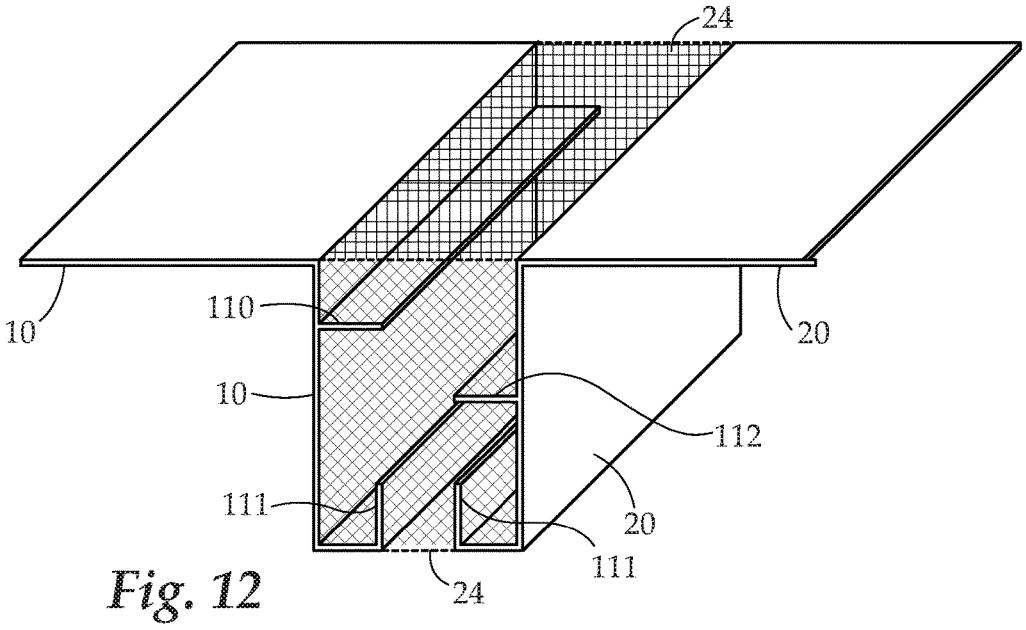
FIG. 12 provides a perspective view of another embodiment of the structural connector.

FIGS. 11 and 12 provides a side view and perspective view of still another embodiment of the structural connector. The first sheet 10 and second sheet 20 both have portions extending away from the vibration damping material 23. The first sheet 10 has a protrusion 110 and inward bent section 111 extending into the vibration damping material 23. The protrusion 110 and inward bent section 111 may act as reinforcing structures. Further, the second sheet 20 has a similar inward protrusion 112 and inward bent section 111.

Figure 13:
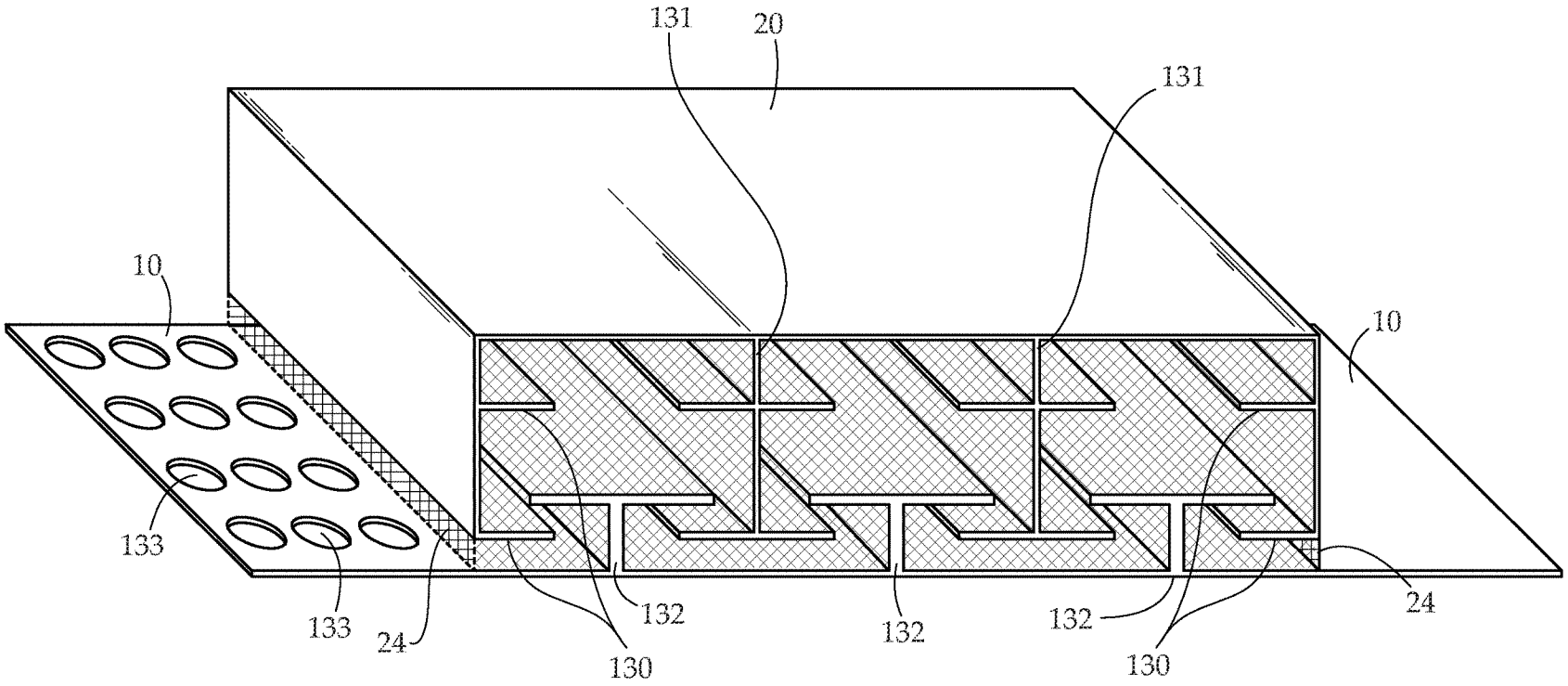
FIG. 13 provides a perspective view of yet another embodiment of the structural connector.
Figure 14:
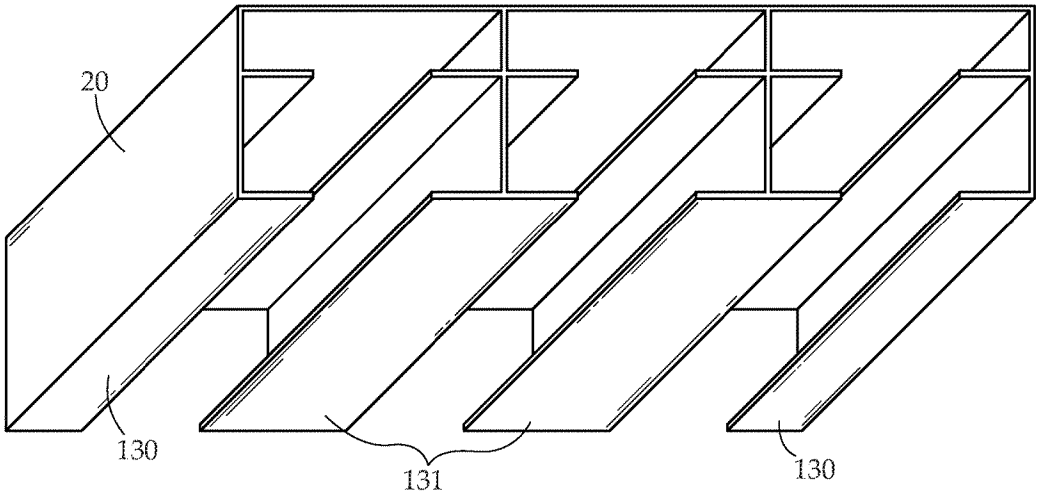
FIG. 14 provides a perspective view of another sheet of an embodiment of the structural connector.
Figure 15:
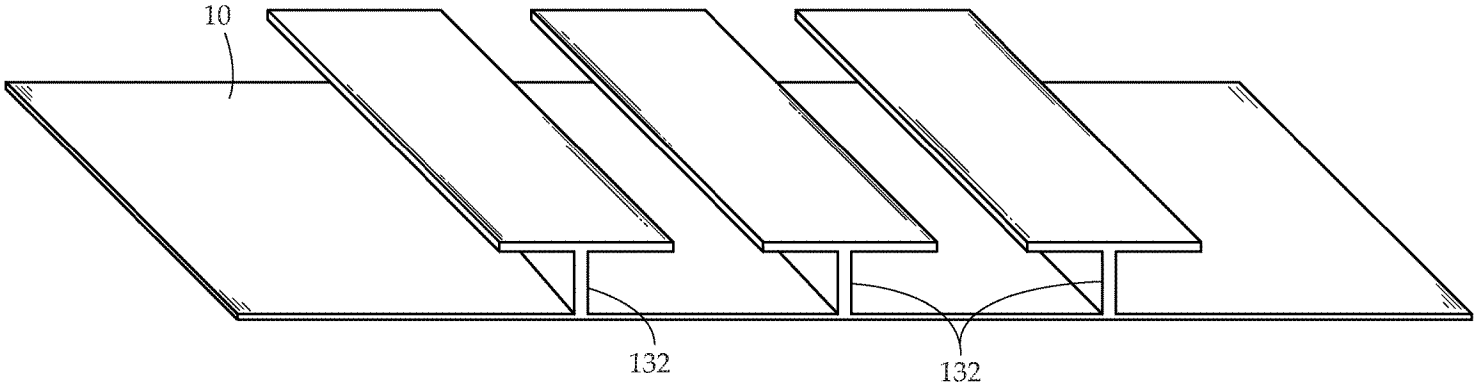
FIG. 15 provides a perspective view of another sheet of an embodiment of the structural connector.

FIGS. 13, 14 and 15 provide different views of another embodiment of the structural connector and it's forming sheets. In this embodiment, the second sheet 20 is positioned above the first sheet 10. The two sheets 10, 20 are joined by a vibration damping material 23 which fills in all space between the first and second sheet 10, 20. A portion of the vibration damping material 23 is exposed 24. A plurality of T-shaped protrusions 132 extend from the first sheet 10. A plurality of stacked T-shaped protrusions 131 extend from the second sheet 20. In one embodiment, a portion of the first sheet 10 extends away from the vibration damping material 23. This portion defines a plurality of perforations 133 which may accommodate fasteners, may reduce the weight of the connector and/or make it easier bend and otherwise work with.

Figure 16:
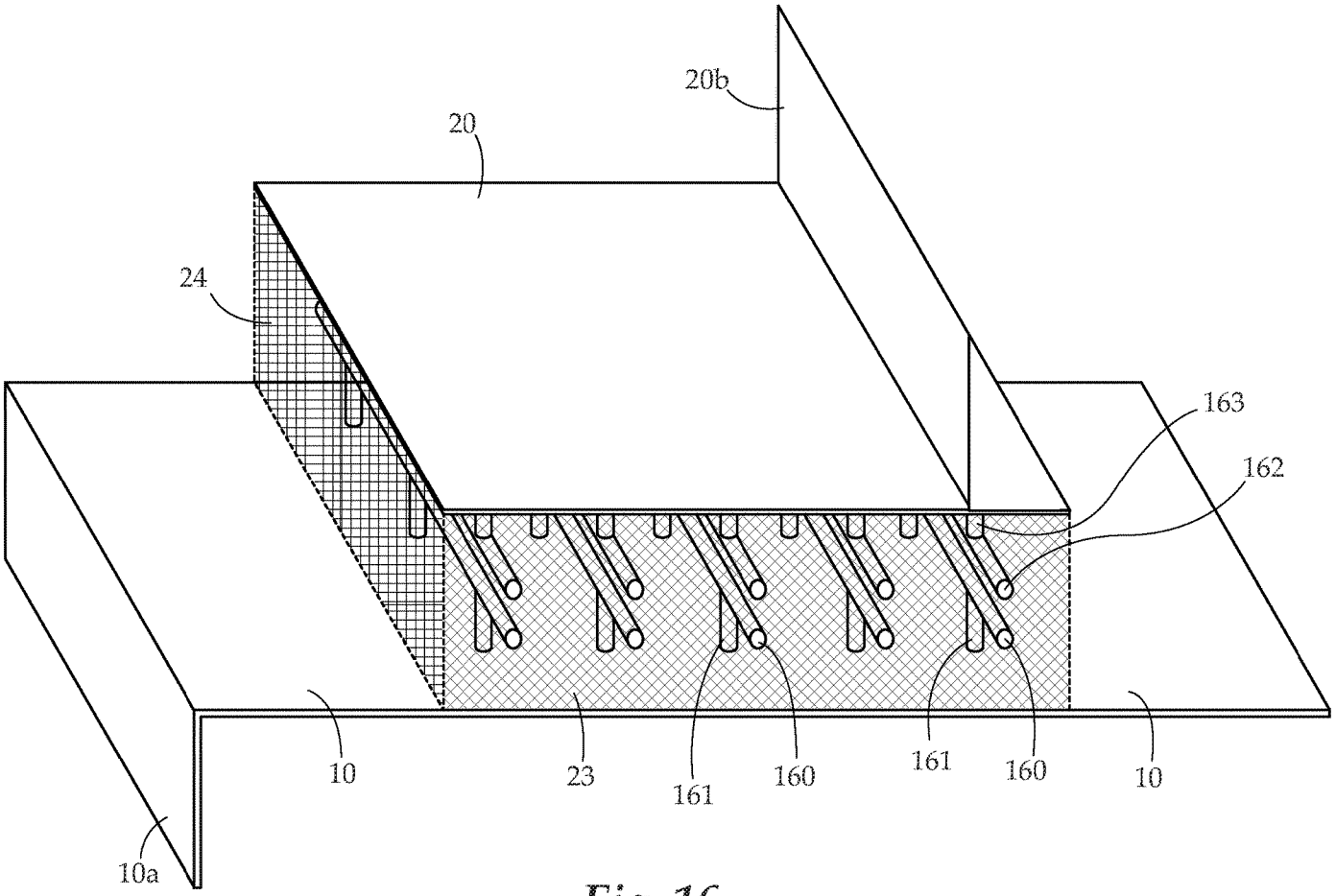
FIG. 16 provides a perspective view of still another embodiment of the structural connector.

FIG. 16 provides a view of another embodiment of the structural connector. The second sheet 20 is positioned above the first sheet 10. The two sheets 10, 20 are joined by a vibration damping material 23 which fills in a space between the first and second sheet 10, 20. A portion of the vibration damping material 23 is exposed 24. The second sheet has a perpendicular portion **20*b* extending away from the vibration damping material 23. Similarly, the first portion has a perpendicular portion 10*a* extending away from the vibration damping material 23. A plurality of reinforcing ladders extend from the first sheet and the second sheet. The reinforcing ladders comprise an elongate element 160 and 162 such as a wire, cable, bar, pipe or the like, and rungs 161 and 163 connecting it to the sheet 10 or 20. The element 160, 162 is oriented substantially parallel to a surface of the first sheet 10. The rungs 161, 163 extend perpendicularly from the element 160, 162 to the sheet 10, 20**.

Figure 17:
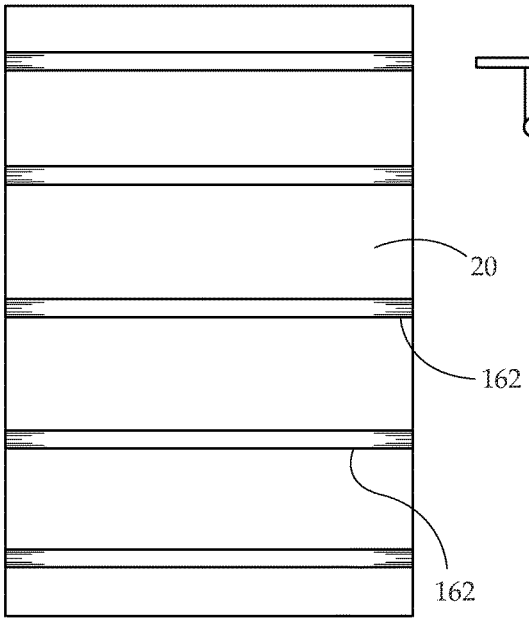
FIG. 17 provides a perspective view of still another sheet of an embodiment of the structural connector.

FIG. 17 provides a top view of an embodiment of a sheet. The second sheet 20 is shown here with the elements 162 extending across its width.

Figure 18:
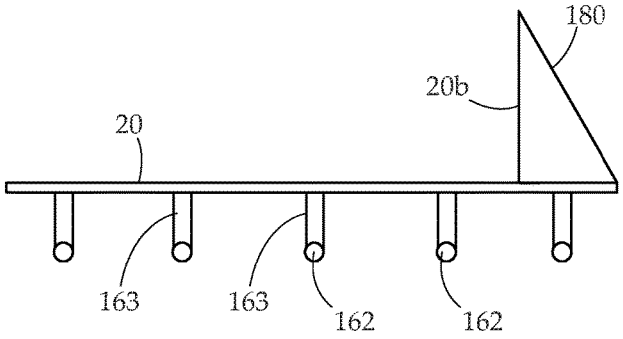
FIG. 18 provides a perspective view of still another sheet of an embodiment of the structural connector.

FIG. 18 provides a cross sectional view of an embodiment of a sheet. The second sheet 20 is shown here having elements 162 extending across its width, and connected to the sheet 20 by rungs 163. A perpendicular extension **20*b* extends from the sheet 20. A second extension 180 extends from an edge of the sheet 20 and joins a top of the perpendicular extension 20*b***, forming a triangular shape.

Figure 19:
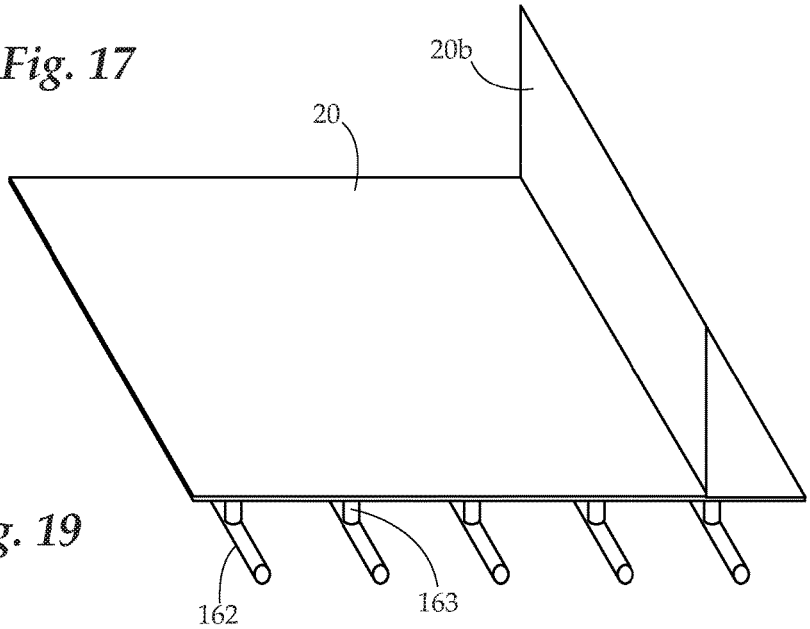
FIG. 19 provides a perspective view of yet another sheet of an embodiment of the structural connector.

FIG. 19 provides a perspective view of an embodiment of a sheet. The second sheet 20 is shown here having elements 162 extending across its width, and connected to the sheet 20 by rungs 163. A perpendicular extension **20*b* extends from the sheet 20**.

Figure 22:
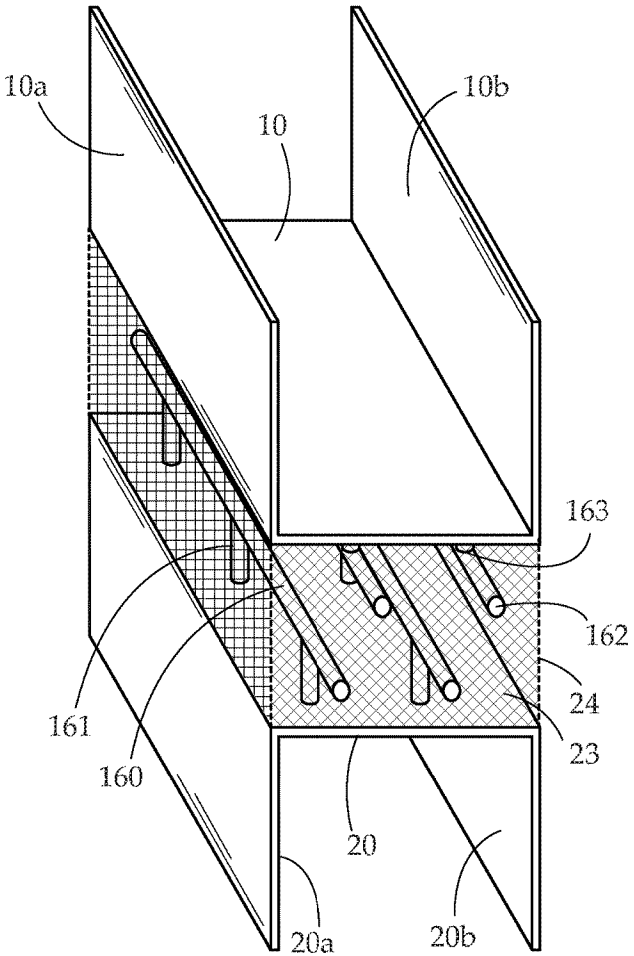
FIG. 22 provides a perspective view of yet still another embodiment of the structural connector.
Figure 21:
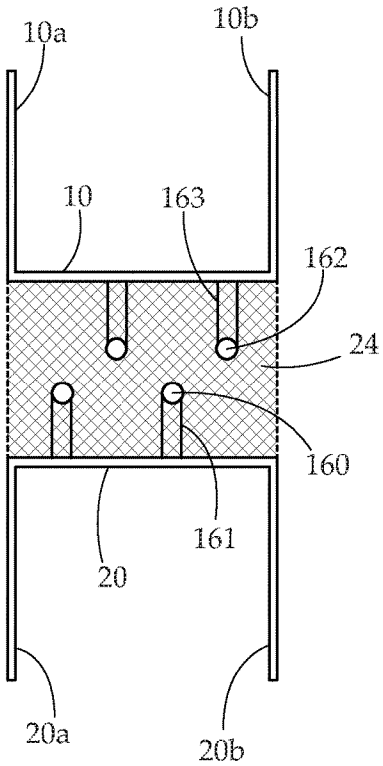
FIG. 21 provides a side view of yet still another embodiment of the structural connector.
Figure 20:
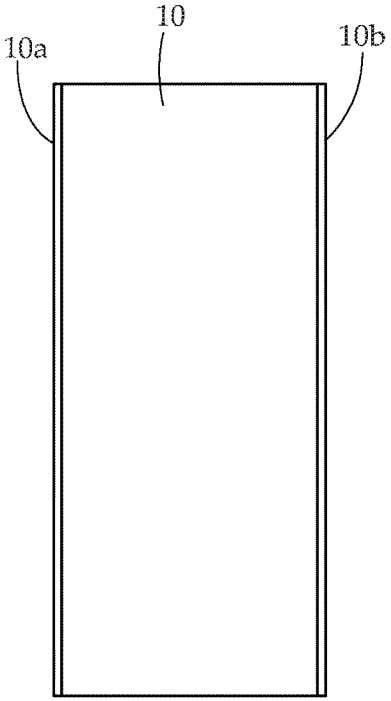
FIG. 20 provides a top view of yet still another embodiment of the structural connector.

FIGS. 20-22 provide views of yet another embodiment of the structural connector. The first sheet 10 is positioned above the second sheet 20. The two sheets 10, 20 are joined by a vibration damping material 23 which fills in all space between the first and second sheet 10, 20. A portion of the vibration damping material 23 is exposed 24. The first sheet 10 has perpendicular portions **10*a*, 10*b* extending away from the vibration damping material 23. Similarly, the second sheet 20 has perpendicular portions 20*a*, 20*b* extending away from the vibration damping material 23. As such, the first and second sheet 10, 20 are formed roughly in a 'U' shape with a flat bottom. A plurality of reinforcing ladders extend from the first sheet and the second sheet. The reinforcing ladders comprise a elongate element 160 and 162 such as a wire, cable, bar, pipe or the like, and rungs 161 and 163 connecting it to the sheet 10 or 20. The element 160, 162 is oriented substantially parallel to a surface of the first sheet 10. The rungs 161, 163 extend perpendicularly from the element 160, 162 to the sheet 10, 20**.

Figure 23:
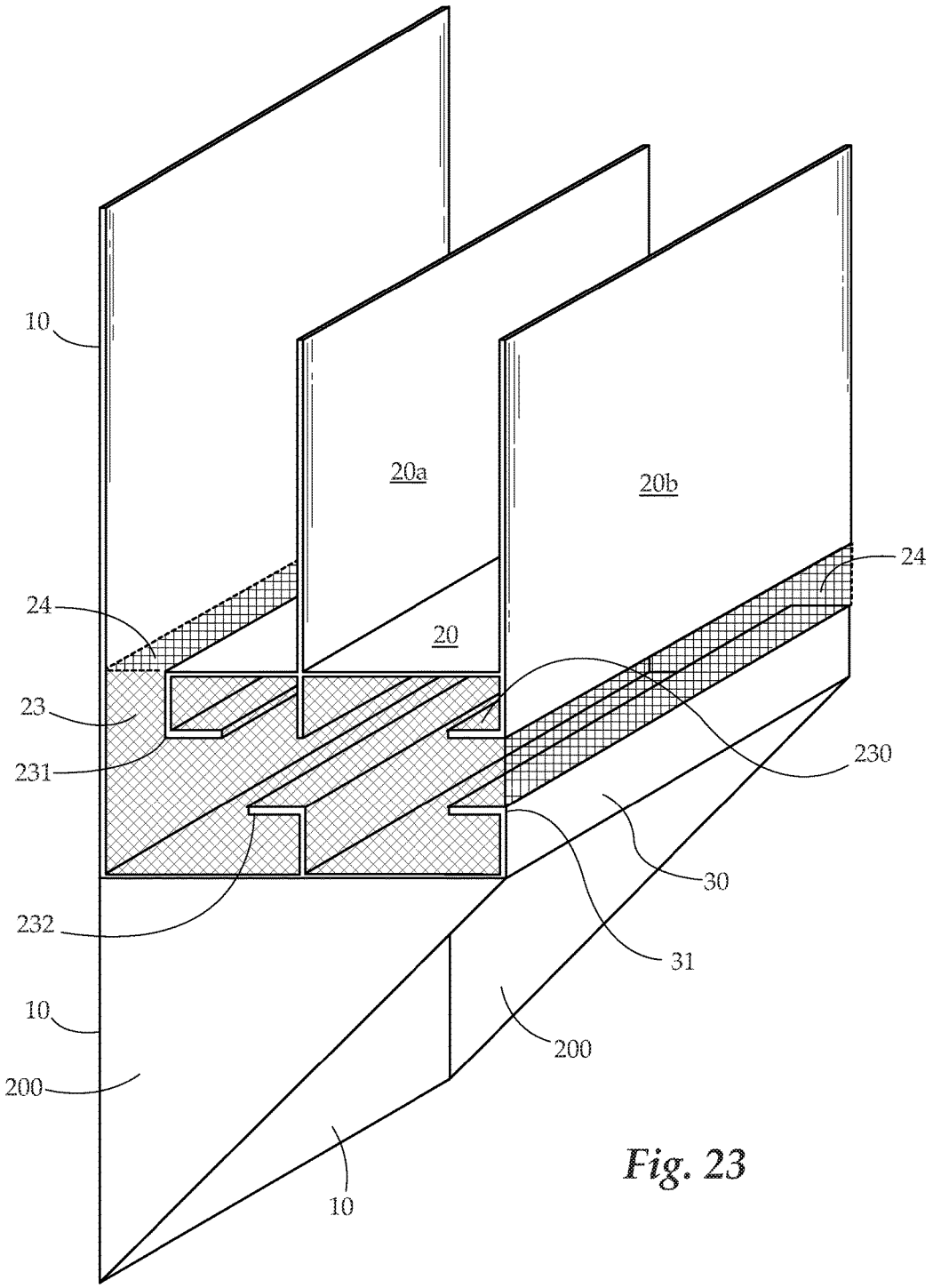
FIG. 23 provides a perspective view of yet another sheet of an embodiment of the structural connector.

FIG. 23 provides still yet another embodiment of the structural connector. The first sheet 10 is positioned adjacent to the second sheet 20. The two sheets 10, 20 are joined by a vibration damping material 23 which fills in all space between the first and second sheet 10, 20. A portion of the vibration damping material 23 is exposed 24. The second sheet has perpendicular portions **20*a*, 20*b* extending away from the vibration damping material 23, perpendicularly to the second sheet 20. The second sheet 20 has an inward protrusion 230 extending into the vibration damping material 23. Further, the second sheet 20 has an L-shaped extension extending into the vibration damping material 23. The first sheet 10 has two portions extending away from the vibration damping material 23. Two triangular shaped supports extend from an edge of the first sheet 10 to an edge of the vibration damping material 23. As such, the first sheet 10 has two perpendicular surfaces attached to the vibration damping material 23. An L-shaped extension 231 extends into the vibration damping material from the first sheet 10. Further, a protrusion 31 extends from a bounding edge 30 of the first sheet into the vibration damping material 23**.

Figure 24:
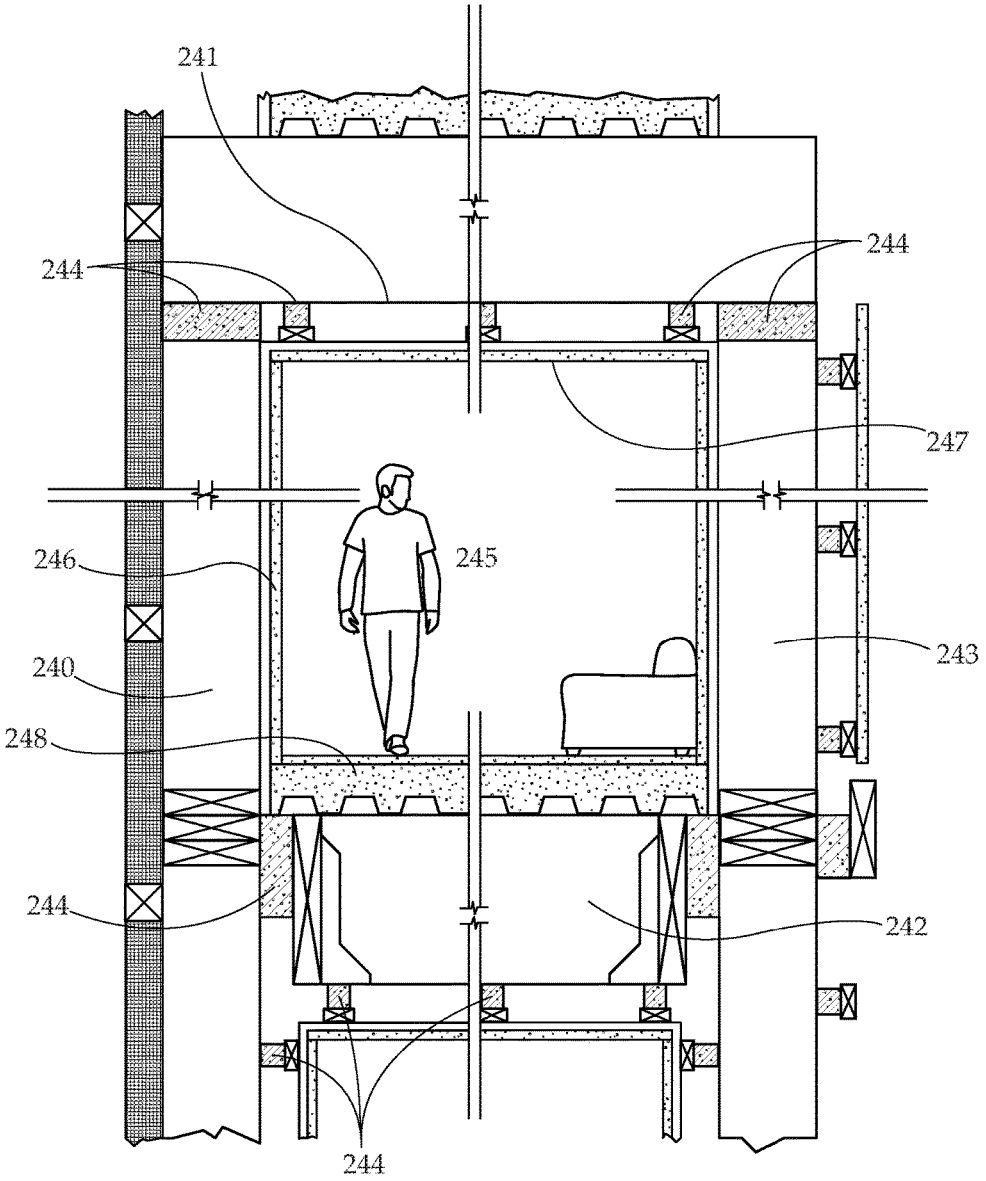
FIG. 24 provides a cutaway view of a structure employing a plurality of the structural connectors.

FIG. 24 provides a building cross sectional view showing a room isolated from rigid connection to the remainder of the building by the structural connectors taught herein. A plurality of structural connectors 244 connect the room 245 and room elements to the studs 240, 243, and joists 241, 242. In particular, ceiling 247 is attached via structural connectors 244 to joist 241. This joist 241 is connected, using structural connectors 244, to a top plate attached to each of studs 240 and 243. Moreover, joist 242 is connected to a bottom plate attached to studs 240, or 243 by structural connectors 244. The floor 248 is connected directly to joist 242, however joist 242 is separated from the studs 240, 243 and their bottom plates by the structural connectors. Walls 246 are shown here directly connected to the studs 240, 243, the studs then being isolated from direct connection from joists 241, 242 by the structural connectors 244. In an alternative embodiment, the walls 246 may be connected to the studs 240, 243 by a structural connector 244.

Figure 25:
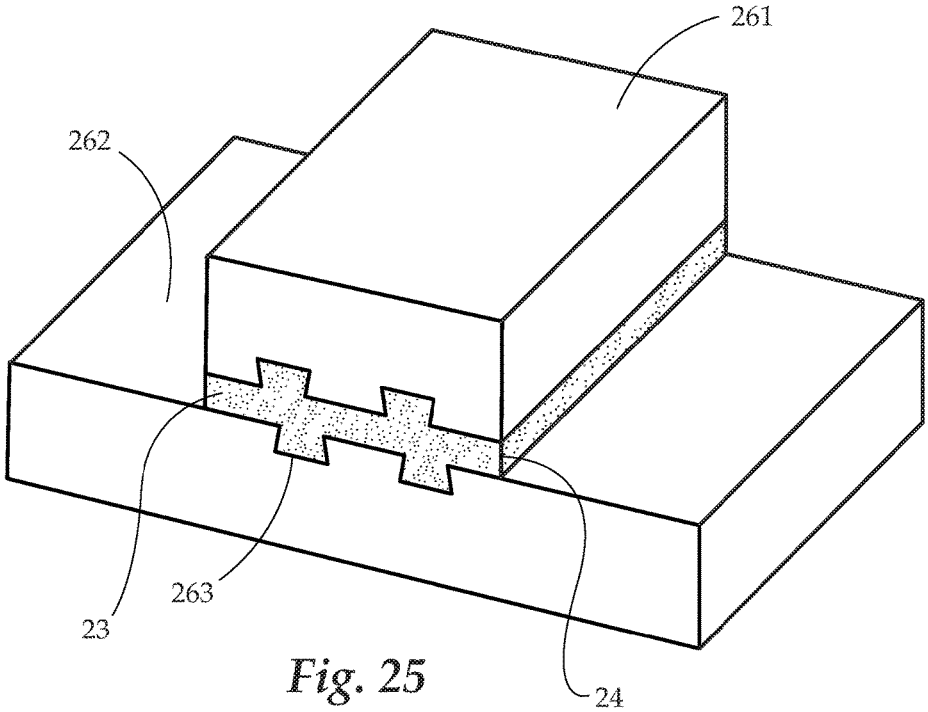
FIG. 25 provides a perspective view of still another embodiment of the structural connector.
Figure 26:
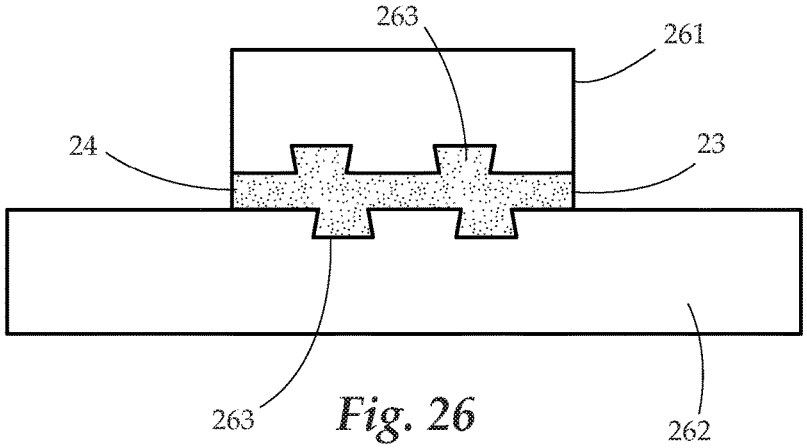
FIG. 26 provides an elevation view of still another embodiment of the structural connector.

FIGS. 25 and 26 provide a view of another embodiment of the structural connector. In this embodiment, first and second sheets 261, 262 are joined together by a vibration damping material 23. In this embodiment, the first and second sheets 261, 261 are formed as blocks. These blocks may be made of any material capable of being joined and used as a structural connector. For example, the blocks may be formed of wood, either solid wood or ply-wood, plastic, metal, composite materials, and the like. Channels 263 extend at least partially into the first and second sheets 261, 262 and are reinforcing structures for the structural connector. In the embodiment shown, the channel 263 is formed as a dovetail channel, and has an expanding width as it approaches the opposite edge of the sheet 261, 262. In some such embodiments, this structure may aid in securing the sheets 261, 262, together. In other embodiments, channel 263 may have a varying shape such as a 'T' shape, rectangular shape, and the like. In many embodiments, the channel will be shaped to help anchor the opposing sheets 261, 262 to the vibration damping material 23.

Figure 27:
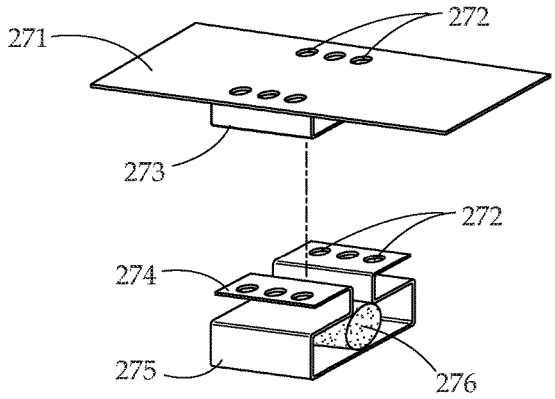
FIG. 27 provides an exploded view of yet another embodiment of the structural connector during its preparation.

FIG. 27 provides an exploded view of an embodiment of the structural connector during its preparation and manufacture. First sheet 271 comprises a flanged reinforcing structure 273, as well as a plurality of holes 272 in the top, as well as the reinforcing structure (not shown). These holes allow introduction of the liquefied vibration damping material (not shown) and also provide a surface for the vibration damping material to form into and around, securing the first and second sheets 271, 275 together. The second sheet 275 is also formed with a reinforcing structure 274. This structure has holes 272 similar to those of the first sheet 271. A spacer 276 is placed in the second sheet 275 so that when the liquefied vibration damping material is introduced, it will not flow out of the area where the reinforcing structures 273, 274 are joined by the material.

Figure 28:
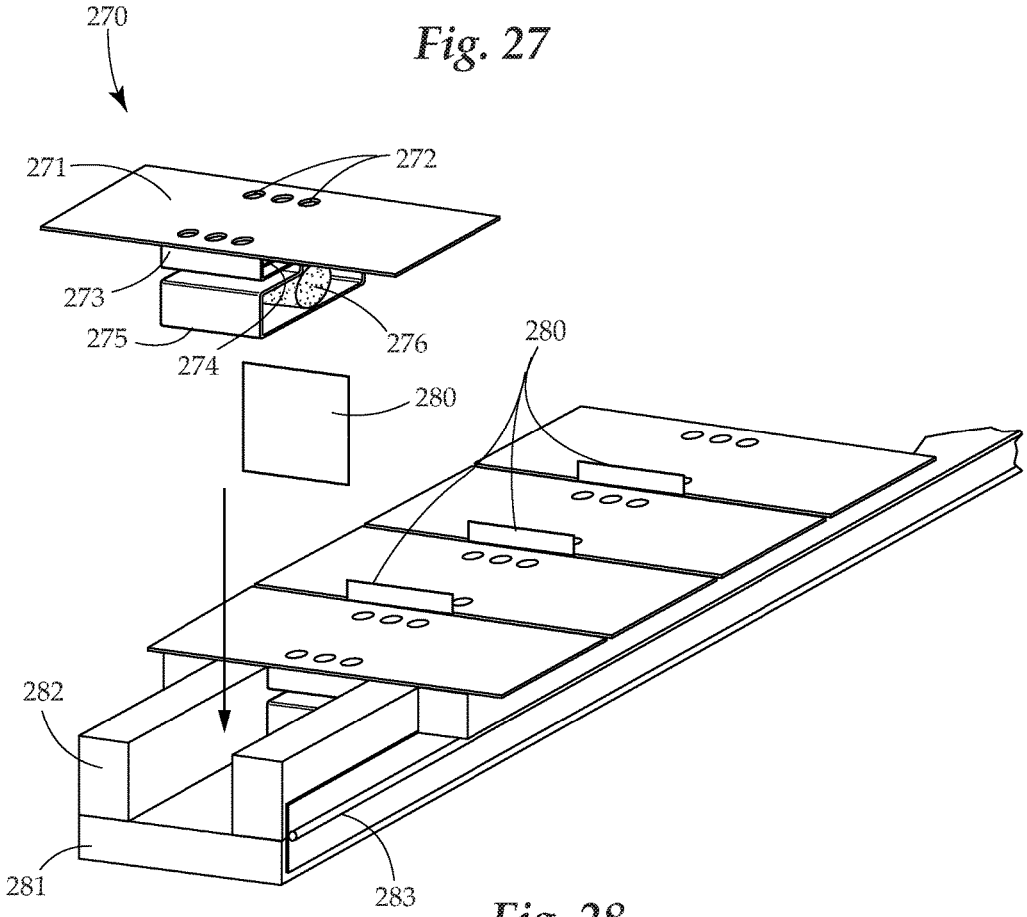
FIG. 28 provides a perspective view of yet another embodiment of the structural connector during its preparation.
Figure 29:
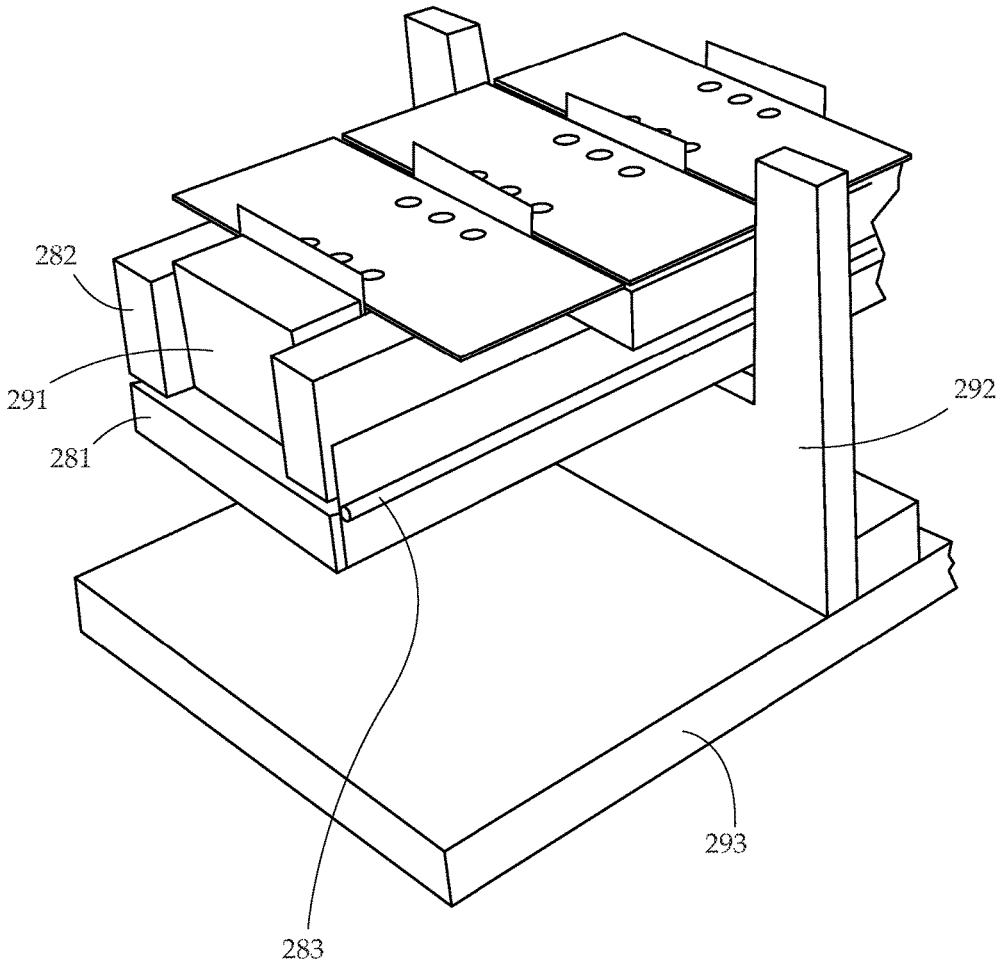
FIG. 29 provides a perspective view of still another embodiment of the structural connector during preparation and the structure used therefor.
Figure 30:
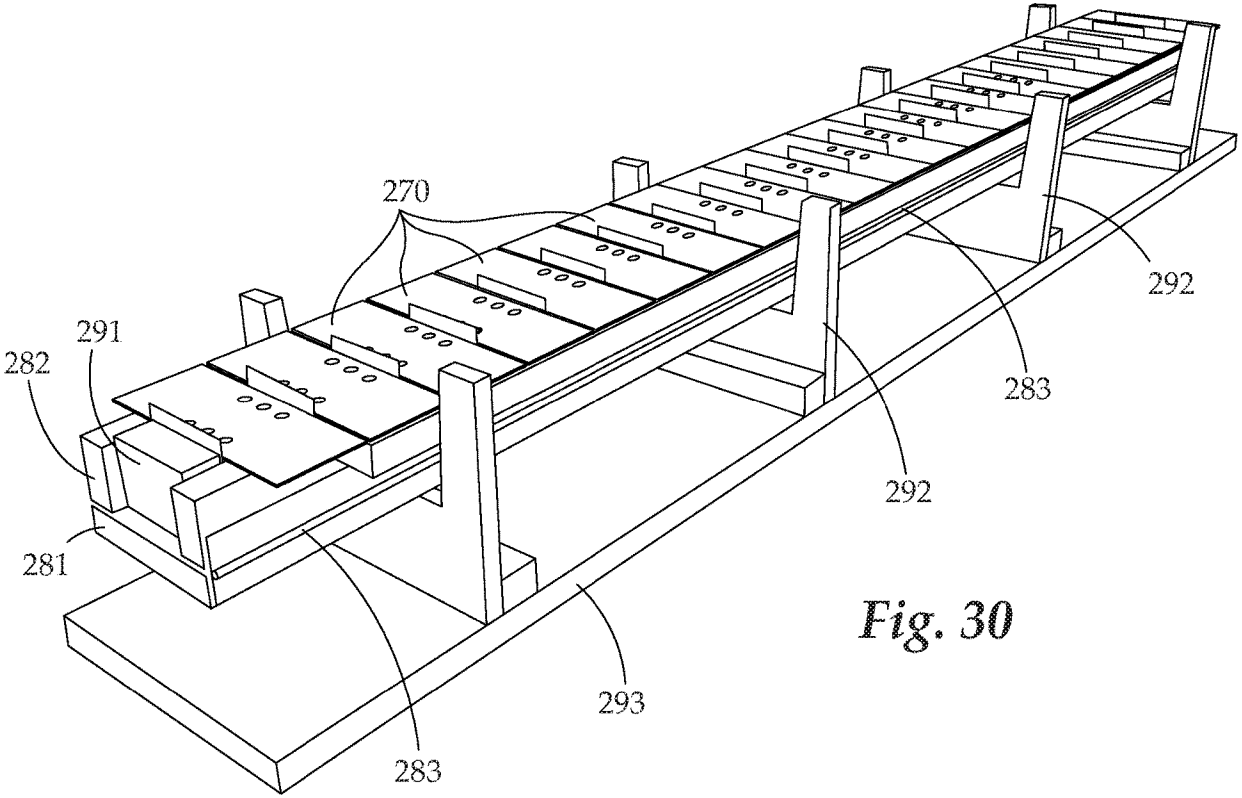
FIG. 30 provides a perspective view of still another embodiment of the structural connector during preparation and the structure used therefor.

FIGS. 28-30 provide views of an embodiment of preparation and manufacture of a structural connector. The structural connector framework 270 has first and second sheets 271, 275 interlocked via their reinforcing structures 273, 274. A spacer 276 is positioned on the second sheet 275. This connector framework 270 may then be positioned in a rack having a base 281, and side-walls 282 which may be hingedly connected to the base by hinge 283. The framework 270 may be placed next to a plurality of other frameworks 270 in the same rack structure. Once placed therein, a liquefied vibration damping material may be introduced to each framework 270, preferably through holes 272. A sheet 280 may be placed between the adjacent frameworks 270 to prevent the vibration damping material from spilling and interacting with the adjacent frameworks 270. Further, the side walls 282 and/or first sheets 271 may be held in place using uprights 292 connected to support 293. An end block 291 may be positioned on a last framework 270 on a row to hold it in place.

Figure 31:
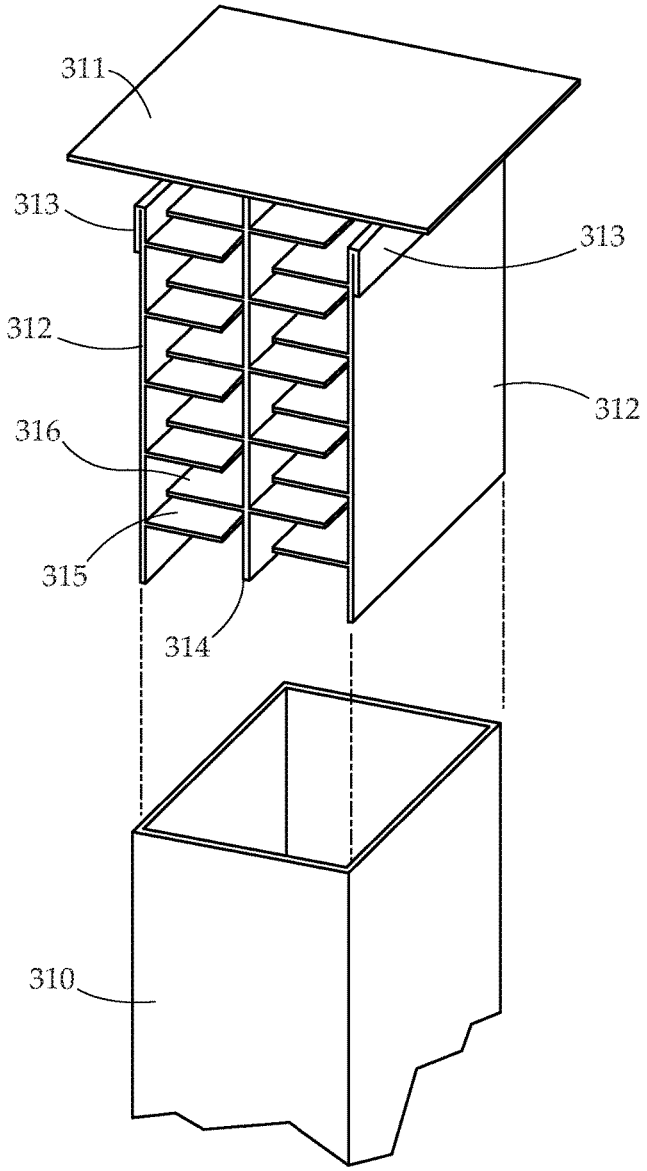
FIG. 31 provides yet another embodiment of a structural connector, shown herein on a post.

FIG. 31 provides yet another embodiment of a structural connector, shown herein on a post. The post base 310 may be any structural post, column, or the like that is vertically oriented and configured to bear a load and be connected to something on its top. The structural connector is configured to connect to a top and/or side of the post 310 and absorb vibrations. Two opposing sheets 312 have projecting reinforcing structures 315 extending from their inner faces. These are spaced between an interior sheet 314 having projecting reinforcing structures 316. The inner sheet 314 is connected to a load bearing top face 311. A vibration damping material joins them together and isolates them from a direct connection. A plurality of these reinforcing structures 315, 316 may be used to accommodate for varying sized loads. Each opposing sheet has a connector 313 that is sized and configured to hook over a top of the hollow post 310, rest on a top edge, or similarly connect. However, it should be understood that any equivalent connector structure may be used without straying from the scope of this invention. The opposing sheets 312 are sized to slide within the hollow post 310.

Figure 32:
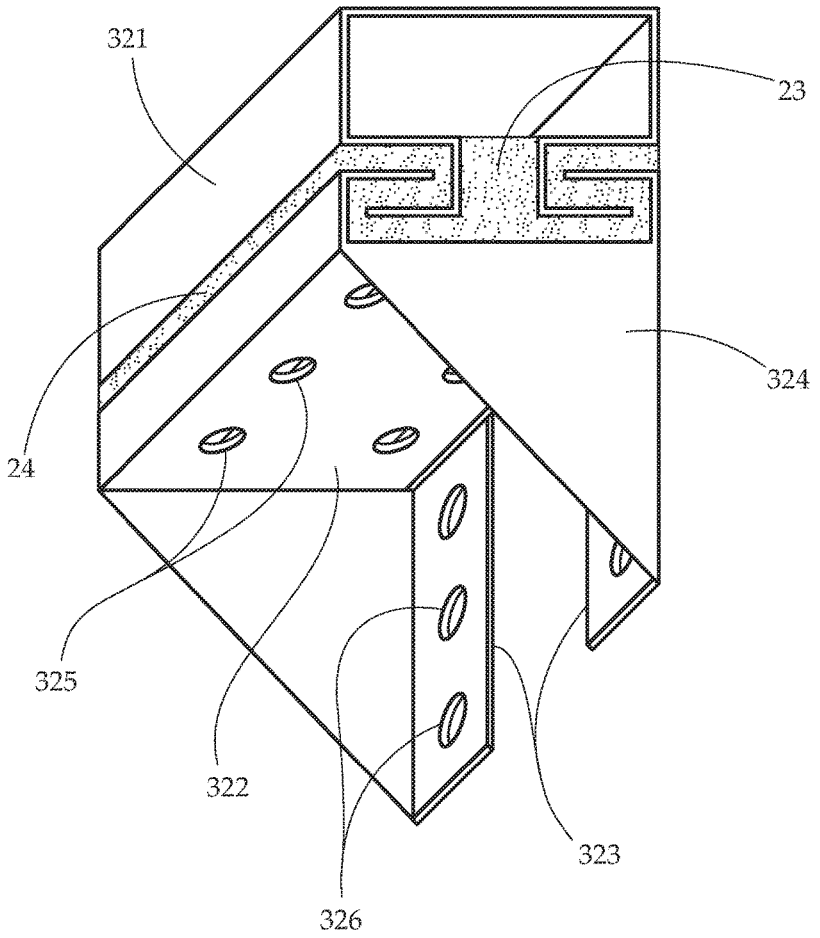
FIG. 32 provides a perspective view of still another embodiment of the structural connector.

FIG. 32 provides a perspective view of still yet another embodiment of the structural connector. The second sheet 321 is positioned above the first sheet 322. The two sheets 321, 322 are joined by a vibration damping material 23 which fills in space between the first and second sheet 322, 321 when in an interlocking but non-contacting position. A portion of the vibration damping material 23 is exposed 24. A reinforcing structure extends from the first and second sheets 322, 321 into the vibration damping material 23. The first sheet 322 defines a plurality of holes 325 into which the vibration damping material 23 may enter. Generally, the holes may be sealed by a thin material preventing the vibration damping material from leaking out if/when in a liquid form. First sheet further comprises extensions 323 that extend away from the sheet and the second sheet 321. Extensions 323 define apertures 326 which may be used for attachment to a solid surface such as a stud or the like. Reinforcing wings 324 extend from the extensions 323 and join to the opposite edge of the first sheet 322.

Figure 33:
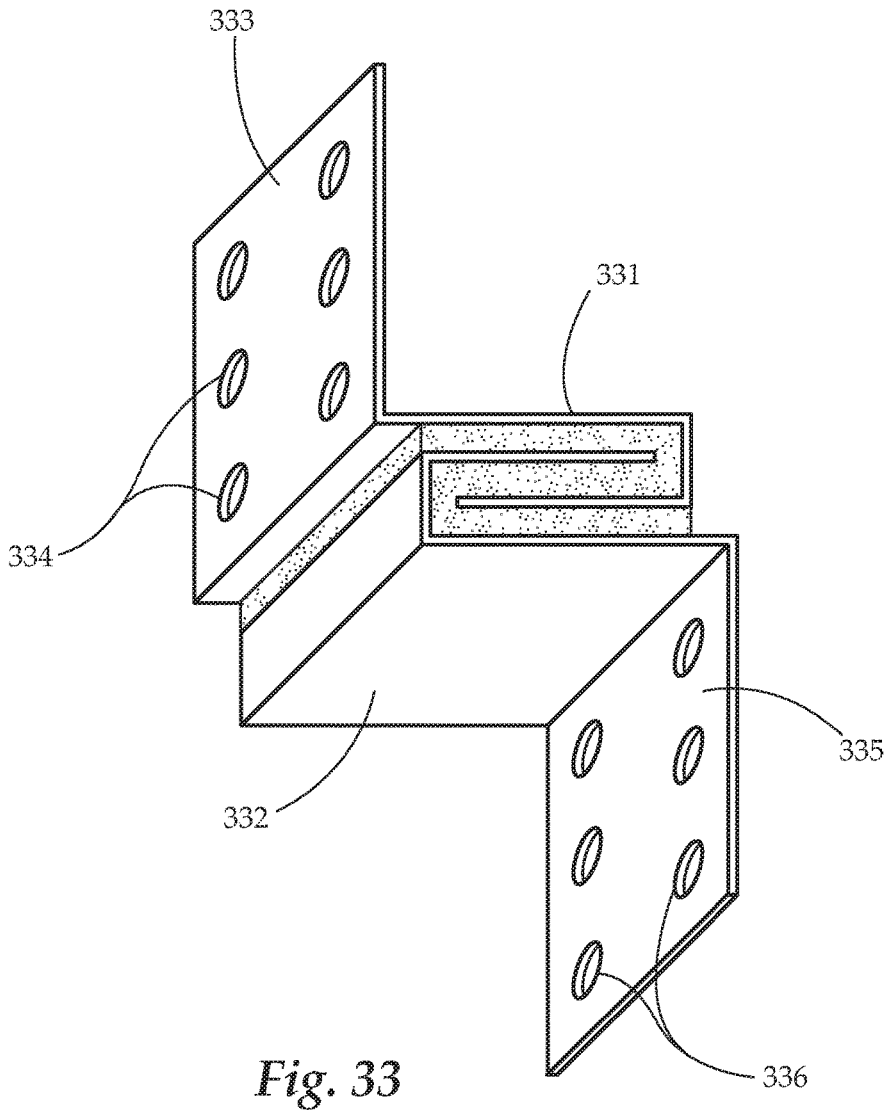
FIG. 33 provides a perspective view of still another embodiment of the structural connector.

FIG. 33 provides a perspective view of still yet another embodiment of the structural connector. The second sheet 331 is positioned above the first sheet 332. The two sheets 321, 322 are joined by a vibration damping material 23 which fills in space between the first and second sheet 332, 331 when in an interlocking but non-contacting position. A portion of the vibration damping material 23 is exposed 24. A reinforcing structure extends from the first and second sheets 322, 321 into the vibration damping material 23. First sheet 332 further comprises extension 335 that extend away from the sheet and the second sheet 321. Extension 323 define apertures 335 which may be used for attachment to a solid surface such as a stud or the like. Similarly, second sheet 331 comprises extension 333 which defines apertures 334.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A structure comprising:

a first structural element;

a second structural element;

a sound-attenuating structural connector comprising:

a first sheet;

a second sheet opposing the first sheet, an outermost face of the second sheet spaced apart from an outermost face of the first sheet, the outermost face of the second sheet facing the outermost face of the first sheet;

a visco-elastic sound-attenuating vibration damping material joining the first sheet and the second sheet, such that no part of the first sheet is in contact with the second sheet, the vibration damping material extending in a lateral plane along the outermost face of the first sheet; and a channel recessed in the outermost face of each of the first sheet and second sheet, the vibration damping material extending into each channel;

wherein the first sheet further comprises an extended portion extending away from the vibration damping material along a plane parallel to the lateral plane of the vibration damping material;

the first sheet attached to the first structural element by a fastener connected to the extended portion; and the second sheet attached to the second structural element.

2. The structure of claim 1 wherein each of the first and second sheet has a plurality of channels.

3. The structure of claim 1 wherein each channel is formed as a dovetail channel.

4. The structure of claim 1 wherein the first and second sheet are wooden blocks.

5. The structure of claim 4 wherein the wooden blocks are formed of a plywood.

6. The structure of claim 1 wherein a length of the first sheet is greater than a length of the second sheet.

7. The structure of claim 1 wherein the first structural element is a building joist connected to the first sheet.

8. The structure of claim 1 wherein the first structural element is a wall assembly connected to the first sheet.

9. The structure of claim 1 wherein the first structural element is a stud of a wall assembly connected to the first sheet.

10. The structure of claim 9 further comprising a furring strip of the wall assembly connected to the second sheet.

11. The structure of claim 1 wherein the first structural element is one of: a floor element, a wall element, a beam, a column, a furring strip, a ceiling element, a stair stringer, a floor landing, a door frame component, a wall opening, a piping, a roof element, a rafter, a stud, a joist, roof connections, and a plate of a wall assembly.

12. The structure of claim 11 wherein the second structural element is one of: a floor element, a wall element, a beam, a column, a furring strip, a ceiling element, a stair stringer, a floor landing, a door frame component, a wall opening, a piping, a roof element, a rafter, a stud, a joist, roof connections, and a plate of a wall assembly.

13. The structure of claim 1 wherein the first sheet is greater in length than the second sheet.

14. The structure of claim 13 wherein the extended portion of the first sheet extends away from a first side of the vibration damping material, and wherein the first sheet further comprises a second extended portion extending away from a second side of the vibration damping material.

15. A structure comprising:

a first structural element;

a second structural element;

a sound-attenuating structural connector comprising:

a first sheet;

a second sheet opposing the first sheet, an outermost face of the second sheet spaced apart from an outermost face of the first sheet, the outermost face of the second sheet facing the outermost face of the first sheet;

a visco-elastic sound-attenuating vibration damping material joining the first sheet and the second sheet, such that no part of the first sheet is in contact with the second sheet; and a channel recessed in the outermost face of each of the first sheet and second sheet, the vibration damping material extending into each channel;

wherein the first sheet further comprises an extended portion extending away from the vibration damping material along a lengthwise plane of the structural connector;

the first sheet attached to the first structural element by a fastener connected to the extended portion; and the second sheet attached to the second structural element.

16. The structure of claim 15 wherein the first sheet is greater in length than the second sheet.

* * * * *